US009396850B2

(12) United States Patent
Yamaguchi et al.

(10) Patent No.: US 9,396,850 B2
(45) Date of Patent: Jul. 19, 2016

(54) GRAIN ORIENTED ELECTRICAL STEEL SHEET AND METHOD FOR MANUFACTURING THE SAME

(75) Inventors: Hiroi Yamaguchi, Tokyo (JP); Hiroaki Toda, Tokyo (JP); Takeshi Omura, Tokyo (JP); Seiji Okabe, Tokyo (JP)

(73) Assignee: JFE Steel Corporation (JP)

( * ) Notice: Subject to any disclaimer, the term of this patent is extended or adjusted under 35 U.S.C. 154(b) by 296 days.

(21) Appl. No.: 13/806,901

(22) PCT Filed: Jun. 28, 2011

(86) PCT No.: PCT/JP2011/003685

§ 371 (c)(1), (2), (4) Date: Jan. 8, 2013

(87) PCT Pub. No.: WO2012/001953

PCT Pub. Date: Jan. 5, 2012

(65) Prior Publication Data

US 2013/0098508 A1 Apr. 25, 2013

(30) Foreign Application Priority Data

Jun. 30, 2010 (JP) ..... 2010-150404

(51) Int. Cl.

| | |
|---|---|
| ***H01F 1/01*** | (2006.01) |
| ***C21D 10/00*** | (2006.01) |
| ***C22C 38/18*** | (2006.01) |
| ***H01F 41/02*** | (2006.01) |
| ***C22C 38/04*** | (2006.01) |
| ***C22C 38/06*** | (2006.01) |
| ***C22C 38/20*** | (2006.01) |
| ***C22C 38/60*** | (2006.01) |
| ***H01F 1/18*** | (2006.01) |
| *C21D 8/12* | (2006.01) |

(52) U.S. Cl.

CPC ..... *H01F 1/01* (2013.01); *C21D 8/1233* (2013.01); *C21D 8/1255* (2013.01); *C21D 8/1261* (2013.01); *C21D 8/1266* (2013.01); *C21D 8/1283* (2013.01); *C21D 8/1288* (2013.01); *C21D 8/1294* (2013.01); *C21D 10/005* (2013.01); *C22C 38/04* (2013.01); *C22C 38/06* (2013.01); *C22C 38/18* (2013.01); *C22C 38/20* (2013.01); *C22C 38/60* (2013.01); *H01F 1/18* (2013.01); *H01F 41/02* (2013.01); *C21D 8/1222* (2013.01); *C21D 8/1272* (2013.01); *C21D 2201/05* (2013.01)

(58) Field of Classification Search

CPC ..... C21D 10/005; C21D 8/1222
USPC ..... 148/100, 111
See application file for complete search history.

(56) References Cited

U.S. PATENT DOCUMENTS

| | | | | | |
|---|---|---|---|---|---|
| 5,509,976 | A * | 4/1996 | Yamazaki et al. | ..... | 148/113 |
| 6,110,298 | A * | 8/2000 | Senda et al. | ..... | 148/308 |
| 2008/0190520 | A1 * | 8/2008 | Watanabe et al. | ..... | 148/537 |

FOREIGN PATENT DOCUMENTS

| | | | | | |
|---|---|---|---|---|---|
| EP | 2 180 082 | A1 | 4/2010 | | |
| JP | 57-002252 | B2 | 1/1982 | | |
| JP | 9-184017 | A | 7/1997 | | |
| JP | H09-184017 | * | 7/1997 | ..... | C21D 9/46 |
| JP | 10-204533 | A | 8/1998 | | |
| JP | 11-279645 | A | 10/1999 | | |
| JP | 2001-107145 | A | 4/2001 | | |
| JP | 2002-302718 | A | 10/2002 | | |
| JP | 2006-117964 | A | 5/2006 | | |
| JP | 2006-152383 | A | 6/2006 | | |
| JP | 2009-041074 | A | 2/2009 | | |

OTHER PUBLICATIONS

Japanese Office Action dated May 7, 2014 from corresponding Japanese Patent Application No. 2010-150404 along with English translation.

English translation of the Notification of Reasons for Refusal dated Jan. 13, 2015 of corresponding Japanese Application No. 2010-150404.

* cited by examiner

*Primary Examiner* — Jie Yang
(74) *Attorney, Agent, or Firm* — DLA Piper LLP (US)

(57) ABSTRACT

A grain oriented electrical steel sheet (1) suppresses the content of Cr in the grain oriented electrical steel sheet to 0.1 mass % or less; (2) sets the coating weight of a forsterite coating, in terms of basis weight of oxygen therein, to at least 3.0 g/m$^2$ and thickness of an anchor portion as a lower portion of forsterite coating to 1.5 μm or less; and (3) controls setting the magnitude of deflection of a test specimen having length: 280 mm to at least 10mm when the forsterite coating is provided on only one surface thereof and at least 20 mm when forsterite coating and the tension coating are provided on the surface.

3 Claims, No Drawings

GRAIN ORIENTED ELECTRICAL STEEL SHEET AND METHOD FOR MANUFACTURING THE SAME

RELATED APPLICATIONS

This is a §371 of International Application No. PCT/JP2011/003685, with an inter-national filing date of Jun. 28, 2011 (WO 2012/001953 A1, published Jan. 5, 2012), which is based on Japanese Patent Application No, 2010-150404, filed Jun. 30, 2010, the subject matter of which is incorporated herein by reference.

TECHNICAL FIELD

This disclosure relates to a grain oriented electrical steel sheet for use in an iron core material of a transformer or the like and a method for manufacturing the grain oriented electrical steel sheet.

BACKGROUND

A grain oriented electrical steel sheet is a material mainly utilized as an iron core of a transformer. A grain oriented electrical steel sheet is therefore required in terms of achieving high efficiency of a transformer and reducing noise thereof to have material properties including low iron loss properties and low magnetostrictive properties.

In this regard, it is important to highly accumulate secondary recrystallized grains of a steel sheet in (110)[001] orientation, i.e., what is called "Goss orientation." However, too high a degree of accumulation of the secondary recrystallized grains in the Goss orientation is known to increase iron loss in a steel sheet. Therefore, there has been developed to solve this problem a technique of introducing strains and grooves into a surface of a steel sheet to subdivide the width of a magnetic domain to reduce iron loss, i.e., magnetic domain refinement technique.

For example, JP-B 57-002252 proposes a technique of irradiating a steel sheet as a finished product with a laser to introduce high-dislocation density regions into a surface layer of the steel sheet, thereby narrowing magnetic domain widths and reducing iron loss of the steel sheet. The magnetic domain refinement technique using laser irradiation was improved thereafter (see JP-A 2006-117964, JP-A 10-204533 and JP-A 11-279645 and the like), so that a grain oriented electrical steel sheet having good iron loss properties can be obtained.

There is a demand for further improvement of iron loss properties of a grain oriented electrical steel sheet due to increasing public awareness of energy-saving and environment protection in recent years. However, the grain oriented electrical steel sheets in JP '252, JP '964, JP '533 and JP '645 described above cannot necessarily possess satisfactory iron loss properties in this regard.

It could therefore be helpful to provide a grain oriented electrical steel sheet capable of causing an improved iron-loss reducing effect in reducing iron loss by controllably modifying magnetic domain structures through laser irradiation, as well as an advantageous method for manufacturing the grain oriented electrical steel sheet.

SUMMARY

We thus provide:

[1] A grain oriented electrical steel sheet having forsterite coating, tension coating and magnetic flux density $B_8$ of 1.91 T or more and subjected to magnetic domain refinement by laser irradiation, wherein: (1) content of Cr mixed into the grain oriented electrical steel sheet is suppressed to 0.1 mass % or less; (2) coating weight of the forsterite coating, in terms of basis weight of oxygen therein, is at least 3.0 g/m$^2$ and thickness of an anchor portion as a lower portion of the forsterite coating, biting a base metal of the grain oriented electrical steel sheet, is 1.5 μm or less; and (3) magnitude of deflection of a test specimen having length; 280 mm and the forsterite coating on only one surface thereof, of the grain oriented electrical steel sheet, is at least 10 mm and magnitude of deflection of a test specimen having length: 280 Tarn and the forsterite coating and the tension coating on only one surface thereof, of the grain oriented electrical steel sheet, is at least 20 ram.

[2] A method for manufacturing a grain oriented electrical steel sheet, comprising a series of processes including: rolling a slab for a grain oriented electrical steel sheet with Cr content mixed therein suppressed to 0.1 mass % or less to obtain a steel sheet having final sheet thickness; subjecting the steel sheet to decarburizing annealing; then coating a surface of the steel sheet with annealing separator mainly composed of MgO; subjecting the steel sheet thus coated to final annealing; providing the steel sheet with tension coating; and subjecting the steel sheet to magnetic domain refinement by laser irradiation in this order, wherein the method further comprises: adjusting at least one of degree of oxidation of atmosphere during the decarburizing annealing, atmosphere in the final annealing, heating pattern in the final annealing, and an additive, to the annealing separator MgO such that coating weight of the forsterite coating formed on the surface of the steel sheet, in terms of basis weight of oxygen therein, is at least 3.0 g/m$^2$, thickness of an anchor portion as a lower portion of the forsterite coating, biting a base metal of the grain oriented electrical steel sheet, is 1.5 μm or less, and magnitude of deflection of a test specimen having length: 280 mm and the forsterite coating on only one surface thereof, of the grain oriented electrical steel sheet, is at least 10 mm; and providing the steel sheet with the tension coating, by coating and baking such that magnitude of deflection of a test specimen having length: 280 mm and the forsterite coating and the tension coating on only one surface thereof, of the grain oriented electrical steel sheet, is at least 20 mm.

[3] The method for manufacturing a grain oriented electrical steel sheet of [2] above, further comprising subjecting the slab for a grain oriented electrical steel sheet to the hot rolling, optionally hot-band annealing, and either one cold rolling operation or at least two cold rolling, operations with intermediate annealing therebetween to obtain a steel sheet having the final sheet thickness.

It is thus possible to obtain a grain oriented electrical steel sheet in which an iron-loss reducing effect through magnetic domain refinement by laser can be more effectively expressed than the prior art.

DETAILED DESCRIPTION

Our steel sheets and methods will be described in detail hereinafter.

A surface layer (of each surface) of a standard-grade grain oriented electrical steel sheet product is constituted of forsterite coating and tension coating, and laser irradiation for reducing iron loss is generally carried out with respect to a surface of the tension coating.

Iron loss of a steel sheet is reduced by laser irradiation thereon because laser irradiation imparts a surface of the steel sheet with thermal strains and, as a result, magnetic domains of the steel sheet are each subdivided to reduce iron loss of the steel sheet.

Forsterite coating and tension coating each cause an effect of imparting a steel sheet with tensile strength. Characteristics of these coatings therefore may affect to some extent thermal strain as a main factor of the iron-loss reducing effect caused by laser irradiation. However, studies on the iron-loss reducing effect by laser irradiation in a steel sheet have conventionally been focused on how laser irradiation conditions should be changed and influences of forsterite and tension coatings on the iron-loss reducing effect have not been well investigated.

it has been revealed by observation that, when very strong thermal strain is introduced to a localized area of a steel sheet by laser irradiation to destroy magnetic domain structure right under the locally irradiated portion, not only the magnetic domain structure right under the locally irradiated portion, but also magnetic domain structures in other areas in vicinities of the locally irradiated area are disturbed due to residual stress of the thermal strain and iron loss increases in these other areas.

It is thus reasonably assumed that reducing the "other areas" described above affected by the residual stress will decrease iron loss. Specifically, for example, increasing surface stress of a steel sheet to a relatively large value by increasing coating tension will excel residual stress of thermal strain, thereby eventually decreasing an area affected by the residual stress of the thermal strain.

In view of this, we concluded that the higher tensile strength of forsterite coating and tension coating exerted in a material to be laser-irradiated is the better.

Tensile strength of a coating provided on a surface of a steel sheet can be evaluated from the magnitude of deflection of the steel sheet when the coating has been removed from the surface. It is known that a thicker coating on a steel sheet results in a larger magnitude of deflection of the steel sheet. That is, it is reasonably assumed that the thicker coating results in the higher tensile strength thereof.

Forsterite coating is formed to bite a base metal (steel) and take on a complicated shape, and a portion thereof biting the base metal is generally referred to as an "anchor" portion (a lower portion of forsterite coating therefore will occasionally be referred to as an "anchor portion" hereinafter). When a steel sheet is irradiated with a laser to introduce optical energy to a base metal of the steel sheet, the less scattering of laser energy in the coating on the steel sheet enables the more effective introduction of the optical energy. The anchor portion having a complicated shape, of forsterite coating, tends to cause scattering of the laser in this regard, although a tension coating made of phosphate-colloidal silica and the upper or remaining portion of a forsterite coating are basically transparent, in short, the thinner anchor portion enables less scattering of the laser in the steel sheet.

Accordingly, it is important to make the coating as a whole relatively thick to enhance tensile strength of the coating and make the anchor portion of the forsterite coating relatively thin to controllably modify magnetic domain structures of a steel sheet by laser irradiation to effectively reduce iron loss. If the anchor portion is too thick, the resulting significant scattering of the laser will lessen the laser-irradiation effect however thick the coatings as a whole are and however high the total tensile strength of the coatings is. Even if the anchor portion is thin, too low a tensile strength of the coating as a whole due to too small a thickness thereof will increase efficiency of laser irradiation on the base metal too much, thereby resulting in excessive introduction of strains. Such over introduction of strains as described above generates residual stress in areas in vicinities of the laser-irradiated area, i.e., expands areas where magnetic domain structures are disturbed. Iron loss is induced and thus the iron-loss reducing effect cannot be sufficiently obtained in such areas where magnetic domain structures are disturbed, as described above.

The higher degree of accumulation of crystal grain orientation after secondary recrystallization in <100> orientation as the axis of easy magnetization results in a higher magnetic domain refinement effect by laser processing. In other words, the higher $B_8$ value as an index of the degree of accumulation of crystal grain orientation results in the higher iron-loss reducing effect by laser irradiation.

Reasons for why chemical compositions and preferred ranges thereof are to be specified as mentioned below will be described hereinafter.

It is known that adding chromium to steel generally decreases tensile strength of a forsterite coating. The mechanism of this phenomenon is not clear, but we assume that the phenomenon occurs because Cr, integrated into the microstructure of forsterite, changes the crystal structure of forsterite. Accordingly, a lesser amount of chromium added to steel is the more advantageous in terms of enhancing tensile strength of the forsterite coating.

Cr: 0.1 mass % or less

Chromium is a useful element in terms of achieving satisfactory hot formability. However, the content of chromium in steel is to be suppressed to 0.1 mass % or less to enhance the tensile strength of the forsterite coating as described above. The presence of chromium in steel by 0.01 mass % or more is acceptable, however, in view of the cost which is incurred if prevention of Cr mixing from raw materials and the like into steel were to be strictly pursued. Coating weight of forsterite coating: at least 3.0 g/m$^2$ in terms of basis weight of oxygen therein The total coating weight of forsterite coating on both surfaces of a steel sheet is to be at least 3.0 g/m$^2$ in terms of basis weight of oxygen therein.

Too thin a forsterite coating or coating weight of the forsterite coating less than 3.0 g/m$^2$ in terms of basis weight of oxygen therein results in too low a tensile strength of the coating and too high efficiency of laser irradiation onto a base metal of a steel sheet, thereby deteriorating iron loss properties of the steel sheet.

Thickness of anchor portion biting base metal, of forsterite coating: 1.5 μm or less The average thickness of the anchor portion of the forsterite coating needs to be 1.5 μm or less. The average thickness of the anchor portion of the forsterite coating exceeding 1.5 μm results in significant scattering of the laser in the anchor portion, thereby lessening the iron loss reducing effect by laser irradiation. That is, the magnetic domain refinement effect is reduced and reduction of eddy current loss is insufficient in this case. Thickness of the anchor portion of forsterite coating is preferably at least 0.2 μm in terms of bend adhesion properties of the coating, although the lower limit of the thickness of the anchor portion is not particularly specified.

The thickness of the anchor portion biting a metal base, of the forsterite coating, can be measured by observation of a section of a steel sheet using a SEM (scanning electron microscope). For example, thickness of an anchor portion of forsterite coating is determined by: observing a section of a steel sheet by a SEM at ×20000 magnification; measuring, in the anchor portion discontinuously observed in the interface between the forsterite coating and the metal base, length from the deepest point of the anchor portion or the tip end thereof most protruding into the base metal, to the interface between the forsterite coating main portion and the root of the anchor portion; and calculating the average of lengths of plural anchor portions thus measured, to regard the average as the thickness of the anchor portion of the steel sheet.

Regarding measurement frequency in the aforementioned SEM observation, five fields are to be arbitrarily extracted per measurement length: 10 cm.

Magnitude of deflection of a steel sheet having a forsterite coating on only one surface thereof: at least 10 mm, and magnitude of deflection of a steel sheet having a forsterite coating and a tension coating on only one surface thereof: at least 20 mm The total tensile strength of the forsterite and tension coatings (insulating coating) of a steel sheet is to be specified according to magnitude of deflection of the steel sheet from which coating(s) has been removed from one surface thereof. Specifically, a test specimen (length: 280 mm, width: 30 mm) having only a forsterite coating on respective surfaces thereof is to be prepared and, when the magnitude of deflection of the test specimen is measured in a state where the forsterite coating on one surface of the specimen has been removed such that the specimen has a forsterite coating only on the other surface thereof, the magnitude of deflection needs to be at least 10 mm. Further, a test specimen (length: 280 mm, width; 30 mm) having a forsterite coating and tension coating on respective surfaces thereof is to be prepared and, when the magnitude of deflection of the test specimen is measured in a state where both the forsterite and tension coatings on one surface of the specimen have been removed such that the specimen has forsterite and insulating coatings only on the other surface thereof, the magnitude of deflection needs to be at least 20 mm.

The aforementioned requirements are necessary because the higher tensile strength of the forsterite and insulating coatings causes a better effect of decreasing areas affected by residual stress of thermal strain, as described above. In a case where the aforementioned magnitudes of deflection are smaller than the above-specified values, respectively, the iron-loss reducing effect is lessened and desired iron loss properties cannot be obtained.

The upper limits for the respective magnitudes of deflection described above are not specified because no problems basically arise if these magnitudes of deflection are increased as high as possible. In a case where the magnitude of deflection of a steel sheet having only a forsterite coating on only one surface of the steel sheet is 20 mm or more, it is not essentially required to further impart the steel sheet with tension with an insulating coating that is the magnitude of deflection of a steel sheet having only a forsterite coating on only one surface of the steel sheet may be approximately equal to the magnitude of deflection of a steel sheet having forsterite and tension coatings on only one surface of the steel sheet). However, it is preferable that the magnitude of deflection of a steel sheet having only a forsterite coating on only one surface of the steel sheet is curbed to less than 20 mm and the total magnitude of deflection of the steel sheet is raised to 20 mm or more by forsterite and tension coatings in combination because setting the total magnitude of deflection of the steel sheet to be 20 mm or more solely by forsterite coating on only one surface of the steel sheet imposes too much load or stress on the production process.

Next, the manufacturing conditions of the grain oriented electrical steel sheet will be described in detail.

The type of chemical composition of a slab for a grain oriented electrical steel sheet is not particularly restricted as long as the chemical composition allows secondary recrystallization to proceed, except that chromium content in the chemical composition is to restricted as described above. The higher degree of accumulation of crystal grain orientation after secondary recrystallization in <100> orientation results in a higher iron-loss reducing effect by laser irradiation, as described above. Setting magnetic flux density $B_8$ as an index of the degree of accumulation of crystal grain orientation after secondary recrystallization to be at least 1.91 T is therefore required for the steel sheet.

The chemical composition of the slab may contain appropriate amounts of Al and N in a case where an inhibitor, e.g., AlN-based inhibitor, is utilized or appropriate amounts of Mn and Se and/or S in a case where MnS.MnSe-based inhibitor is utilized. Both AlN-based inhibitor and MnS.MnSe-based inhibitor may be used in combination, of course. When inhibitors are used as described above, the contents of Al, N, S and Se in the chemical composition are preferably Al: 0.01 mass % to 0.065 mass %, N: 0.005 mass % to 0.012 mass %, S: 0.005 mass % to 0.03 mass %, and Se: 0.005 mass % to 0.03 mass %, respectively.

Our methods are also applicable to a grain oriented electrical steel sheet without using any inhibitor and having restricted Al, N, S, Se contents.

In the case of a grain oriented electrical steel sheet manufactured by such an inhibitorless process as described above, the Contents of Al, N, S and Se are preferably suppressed to Al: 100 mass ppm or less, N: 50 mass ppm or less, S: 50 mass ppm or less, and Se: 50 mass ppm or less, respectively.

Specific examples of basic components and other components to be optionally added of a slab for the grain oriented electrical steel sheet are as follows.

C: 0.08 Mass % or Less

Carbon is added to improve the microstructure of a hot rolled steel sheet. Carbon content in the slab is preferably 0.08 mass % or less because carbon content exceeding 0.08 mass % increases the burden of reducing the carbon content during the manufacturing process to 50 mass ppm at which magnetic aging is reliably prevented. The lower limit of carbon content in the slab need not be particularly set because secondary recrystallization is possible in a material not containing carbon.

Si: 2.0 Mass % to 8.0 Mass %

Silicon is an element which effectively increases electrical resistance of steel to improve iron loss properties thereof. A silicon content in the slab equal to or higher than 2.0 mass % ensures a particularly good effect of reducing iron loss. On the other hand, an Si content in the slab equal to or lower than 8.0 mass % ensures particularly good formability and magnetic flux density of a resulting steel sheet. Accordingly, Si content in the slab is preferably in the range of 2.0 mass % to 8.0 mass %.

Mn: 0.005 Mass % to 1.0 Mass %

Manganese is an element which advantageously achieves good hot-formability of a steel sheet. The manganese content in the slab less than 0.005 mass % cannot sufficiently cause the good effect of Mn addition. A manganese content in the slab equal to or lower than 1.0 mass ensures particularly good magnetic flux density of a product steel sheet. Accordingly. Mn content in the slab is preferably 0.005 mass % to 1.0 mass %.

Further, the slab for the grain oriented electrical steel sheet may contain the following elements as magnetic properties improving components in addition to the basic components described above.

At least one element selected from Ni: 0.03 mass % to 1.50 mass % Sn: 0.01 mass % to 1.50 mass %, Sb: 0.005 mass % to 1.50 mass % Cu: 0.03 mass % to 3.0 mass %, P: 0.03 mass % to 0.50 mass %, and Mo: 0.005 mass % to 0.10 mass %

Nickel is a useful element in terms of further improving the microstructure of a hot roiled steel sheet and thus the magnetic properties of a resulting steel sheet product. Nickel con-tent in the slab less than 0.03 mass % cannot sufficiently cause this magnetic properties-improving effect by Ni. A nickel content in the slab equal to or lower than 1.5 mass % ensures stability in secondary recrystallization to improve magnetic properties of a resulting steel sheet product. Accordingly, Ni content in the slab is preferably in the range of 0.03 mass % to 1.5 mass %.

Sn, Sb, Cu, P and Mo are useful elements, respectively, in terms of further improving magnetic properties of the steel sheet. A content of these elements lower than the respective lower limits described above result in an insufficient magnetic properties-improving effect. Contents of these elements equal to or lower than the respective upper limits described above ensure the optimum growth of secondary recrystallized grains. Accordingly, it is preferable that the slab contains at least one of Sit, Sb, Cu, P and Mo within the respective ranges thereof specified above. The balance other than the aforementioned components of the slab is preferably Fe and incidental impurities incidentally mixed into the steel during the manufacturing process.

The slab having the aforementioned chemical composition is then either heated and hot rolled according to a conventional method or hot rolled without being heated immediately after casting. In a case of a thin slab or thinner cast steel, the thin slab, or the like may be either directly hot rolled or skip hot rolling to proceed to the subsequent processes.

A hot rolled steel sheet thus obtained is then optionally subjected to hot-band annealing. The primary object of hot-band annealing is to eliminate band texture generated in hot rolling to make grain size of primary recrystallized texture even, thereby allowing the Goss texture to further grow during secondary recrystallization annealing so that magnetic properties of the steel sheet improve. The temperature in the hot-band annealing is preferably 800° C. to 1100° C. in terms of ensuring excellent growth of the Goss texture in a product steel sheet. A hot-band annealing temperature lower than 800° C. allows band texture derived from hot rolling to remain, thereby making it difficult to realize uniform grain size of primary recrystallization texture and thus failing to improve secondary recrystallization as desired. On the other hand, a hot-band annealing temperature exceeding 1100° C. excessively coarsens grains after hot-band annealing, thereby making it difficult to realize uniform grain size of primary recrystallization texture.

The steel sheet, after the optional hot-band annealing, is subjected to either one cold rolling operation or at least two cold rolling operations with intermediate annealing therebetween. The steel sheet is then subjected to decarburizing annealing (which also serves as recrystallization annealing), coating of annealing separator, and final annealing for secondary recrystallization and formation of forsterite coating in this order.

The grain oriented electrical steel sheet is manufactured such that at least one of following conditions (a) to (d) is satisfied to ensure provision of a relatively thick forsterite coating on the steel sheet with a relatively small anchor portion thereof biting the base metal.

(a) Degree of Oxidation of Atmosphere During Decarburizing Annealing

A primary coating mainly composed of fayalite ($Fe_2SiO_4$) formed in decarburizing annealing is relatively thick (thicker than the conventional thickness). The primary coating is preferably provided such that the coating weight thereof in terms of basis weight of oxygen therein of surfaces (total of both sides) of a steel sheet is at least 1.0 g/m$^2$ because the forsterite ($Mg_2SiO_4$) coating formed in the subsequent final annealing is thick enough and, also, additional oxidation is suppressed, whereby growth of the anchor portion (the anchor portion grows as a result of additional oxidation) can be suppressed. The coating weight of the primary coating in terms of basis weight of oxygen therein is preferably not higher than 2.0 g/m$^2$ in terms of obtaining good appearance of a steel sheet product.

(b) Atmosphere in the Final Annealing

The aforementioned additional oxidation and resulting growth of the anchor portion can be suppressed by adding hydrogen in a heating process from 800° C. or so to 1200° C. or so. The concentration of hydrogen to be added, which is basically determined according to the temperature range, composition of the selected annealing separator and the like, is preferably set to a higher partial pressure than the conventional setting.

(c) Heating Pattern in Final Annealing

Increasing the heating rate up to temperature around 1200° C. as the final-end-point is preferable in terms of maintaining morphology of the primary coating formed during decarburizing annealing and also preventing the anchor portion from growing. The heating rate is preferably at least 15° C./hour. The upper limit of the heating rate is generally around 50° C./hour in view of restrictions on relevant facilities, although the upper limit is not particularly limited.

(d) Annealing Separator MgO

Adding an alkali metal compound or an alkaline earth metal compound to the annealing separator mainly composed of MgO is effective. Examples of the alkali metal compound or the alkaline earth metal compound include hydroxide, sulfide and the like, without any particular restriction. It is preferable that at least one type of an alkali metal compound or an alkaline earth metal compound is added by 0.5 parts by mass or more with respect to 100 parts by mass of MgO.

The annealing separator is mainly composed of MgO. "The annealing separator is mainly composed of MgO" means that the annealing separator may further contain known annealing separator components and property-improving components other than MgO unless presence of such other components adversely affects formation of the forsterite coating.

It is possible by adequately adjusting at least one of the conditions (a) to (d) above to obtain: thickness of 1.5 μm or less of an anchor portion as a lower portion of the forsterite coating, although the coating weight of the forsterite coating formed on respective surfaces of the steel sheet in terms of basis weight of oxygen therein is at least 3.0 g/m$^2$, which anchor portion bites a base metal of the grain oriented electrical steel sheet; and the magnitude of deflection of at least 10 mm, of a test specimen having length: 280 mm and the forsterite coating on only one surface thereof of the grain oriented electrical steel sheet.

Shape correction is effectively carried out by flattening annealing after the final annealing. Respective surfaces of each of steel sheets are provided with tension coatings either before or after the flattening annealing to effectively improve iron loss properties in a case where these steel sheets are laminated in use. The tension coating is generally made of phosphate-colloidal silica based glass coating. However, the tension coating may be made of any amorphous oxide such as borate-alumina based oxide, which is transparent with no grain boundary, induces relatively little scattering and absorption within tension coating and thus causes a relatively small influence on efficiency of laser irradiation.

It is essential, in formation of tension coating by coating and baking, to provide a steel sheet with tension coating by controllably adjusting coating conditions (e.g., increase in coating weight), baking conditions (e.g., temperature, baking time, heating pattern), such that magnitude of deflection of the steel sheet having forsterite coating and tension coating on only one surface thereof is at least 20 mm as described above.

The magnetic domain is subdivided by irradiating respective surfaces of a steel sheet with a laser after provision of the tension coating.

Either continuous-wave laser or pulse laser can be used as source of the laser to be irradiated. Types of laser, e.g., YAG laser, $CO_2$ laser and the like, are not restricted, either. A laser-irradiated mark may take on either a linear or spot-like shape. The laser-irradiated mark is preferably inclined by 90° to 45° with respect to the rolling direction of a steel sheet.

Green laser marking, which has been increasingly used recently, is particularly preferable in terms of irradiation precision.

Laser output of green laser marking is preferably 5 J/m to 100 J/m or so when expressed as quantity of heat per unit length. The spot diameter of the laser beam is preferably 0.1 mm to 0.5 mm or so and repetition interval in the rolling direction is preferably 1 mm to 20 mm or so.

The depth of plastic strain imparted to a steel sheet is preferably approximately 3 μm to 60 μm.

The conventionally known method for manufacturing a grain oriented electrical steel sheet may be applied to the aspects other than the aforementioned processes and manufacturing conditions such that $B_8$ is reliably 1.91 T or more.

EXAMPLES

Experiment 1

Cold rolled steel sheet samples were prepared by: obtaining steel sample A having chemical composition including by mass %. C: 0.08%, Si: 3.3%, Mn: 0.07%, Se: 0.016%, Al: 0.016%, Cu: 0.12%, Cr: 0.13%, and Fe and incidental impurities as the balance and steel sample B having the same chemical composition as steel sample A, except that Cr was not added to steel sample B, by steelmaking, respectively; casting by continuous casting steel sample A and steel sample B, respectively, into steel slabs each having thickness: 70 mm; subjecting the slabs to heating to 1400° C. and hot rolling to obtain hot-rolled steel sheets each having sheet thickness: 2.6 min in a coiled state; subjecting the hot-rolled steel sheets to cold roiling to thickness: 1.9 mm by a tandem rolling mil, intermediate annealing at 1100° C., and another cold rolling operation to the final sheet thickness of 0.23 mm by a Sendzimir rolling mill.

Next, each of the cold rolled steel sheet samples was subjected to: decarburizing annealing in wet hydrogen atmosphere at 800° C.; coating of an annealing separator prepared by adding 10 parts by mass of $TiO_2$ to MgO: 100 parts by mass; and final annealing at 1150° C.

At least one of manufacturing condition requirements (a) to (d) described below was controllably met during the manufacturing processes described above.

(a) Degree of Oxidation of Atmosphere During Decarburizing Annealing

Degree of oxidation of atmosphere during decarburizing annealing was variously adjusted such that $PH_2O/PH_2$ of the atmosphere was in the range of 0.20 to 0.55.

(b) Atmosphere in the Final Annealing

Hydrogen concentration in the heating process of 800° C. to 1150° C. was variously adjusted to 0% to 75%.

(c) Heating pattern in Final Annealing

The average heating rate between 500° C. and 1150° C. was variously adjusted to 5° C./hour to 30° C./hour.

(d) Annealing Separator MgO

Strontium sulfate was added to the annealing separator by 0 to 10 parts by mass with respect to MgO: 100 parts by mass.

The coating weight of surface oxide formed on surfaces of each steel sheet sample was measured and a section of the surface oxide of the steel sheet sample was observed by using a secondary electron microscope at ×20000 magnification to determine thickness of the portion biting the base metal, of the surface oxide, i.e., an anchor portion of the surface oxide, at the stage of completing the final annealing. Further, a test piece where the surface oxide (forsterite coating) had been removed from only one surface thereof by hot hydrochloric acid was prepared from the steel sheet sample. The test piece thus prepared was slightly pressed against a flat surface and then the magnitude of deflection of the test piece was measured to evaluate tensile strength of coating derived from the surface oxide.

Yet further, the steel sheet samples were coated with insulating coating mainly composed of colloidal silica and magnesium phosphate at controllably changed thickness and baked at 800° C. Magnetic domain refinement was then carried out for each of the steel sheet samples by using 100 W fiber laser in a direction orthogonal to the rolling direction under conditions including scanning; rate in the sheet width direction: 10 m/second, irradiation pitch in the rolling direction: 5 mm, irradiation width: 150 μm, and irradiation interval: 7.5 mm. The steel sheet sample thus subjected to magnetic domain refinement was sheared to obtain test pieces each having length: 280 mm, width: 30 mm. Some test pieces were subjected to evaluation of magnetic properties including measurements of iron loss $W_{17/50}$ and magnetic flux density $B_8$ values. Further, a test piece where both the insulating coating and surface oxide had been removed from only one surface by hot hydrochloric acid was slightly pressed against a flat surface and then the magnitude of deflection of the test piece was measured to evaluate the tensile strength of the coating derived from the surface oxide and the insulating coating.

The coating weight of the surface oxide after the final annealing, thickness of the anchor portion of the surface oxide after the final annealing, and magnitudes of deflection and magnetic properties of test pieces of each of the steel sheet samples are shown in Table 1.

TABLE 1

| No. | Steel sample ID | Condition requirement(s) selected in the final annealing | Coating weight in terms of basis weight of oxygen ($g/m^2$) | Thickness of anchor portion (μm) | Deflection caused by surface oxide (mm) | Deflection caused by surface oxide + insulating coating (mm) | Magnetic flux density $B_8$ (T) | Iron loss $W_{17/50}$ (W/kg) | Added amount of Cr (mass %) | Note |
|---|---|---|---|---|---|---|---|---|---|---|
| 1 | B | (a) | 2.5 | 0.7 | 8.5 | 19 | 1.925 | 0.77 | — | Comp. Example |
| 2 | B | (a) + (b) + (c) | 3.2 | 1.0 | 11.5 | 23 | 1.930 | 0.69 | — | Example |

TABLE 1-continued

| No. | Steel sample ID | Condition requirement(s) selected in the final annealing | Coating weight in terms of basis weight of oxygan ($g/m^2$) | Thickness of anchor portion (μm) | Deflection caused by surface oxide (mm) | Deflection caused by surface oxide + insulating coating (mm) | Magnetic flux density $B_8$ (T) | Iron loss $W_{17/50}$ (W/kg) | Added amount of Cr (mass %) | Note |
|---|---|---|---|---|---|---|---|---|---|---|
| 3 | B | (b) + (d) | 3.4 | 1.7 | 12.0 | 24 | 1.928 | 0.75 | — | Comp. Example |
| 4 | B | (c) | 3.2 | 1.0 | 11.5 | 17 | 1.931 | 0.75 | — | Comp. Example |
| 5 | B | (b) | 3.8 | 1.3 | 13.5 | 27 | 1.905 | 0.79 | — | Comp. Example |
| 6 | B | (b) + (c) + (d) | 3.5 | 1.2 | 12.5 | 30 | 1.933 | 0.68 | — | Example |
| 7 | B | (a) + (c) + (d) | 4.3 | 1.3 | 14.0 | 32 | 1.930 | 0.69 | — | Example |
| 8 | A | (d) | 4.0 | 1.6 | 14.5 | 32 | 1.929 | 0.79 | 0.13 | Comp. Example |
| 9 | A | (c) + (d) | 3.6 | 1.3 | 13.5 | 30 | 1.925 | 0.80 | 0.13 | Comp. Example |
| 10 | A | (b) + (c) + (d) | 4.1 | 1.4 | 15.0 | 35 | 1.905 | 0.81 | 0.13 | Comp. Example |

※ Explanation of symbols of condition requirements selected in final annealing
(a) Degree of oxidation of atmosphere during decarburizing annealing
(b) Atmosphere in final annealing
(c) Heating pattern in final annealing
(d) Annealing separator MgO Steel sheet samples Nos. 2, 6 and 7 within our range each exhibited good iron loss properties as shown in Table 1. Specifically, at least one of manufacturing condition requirements (a) to (d) was adequately met in steel sheet samples Nos. 2, 6 and 7, whereby coating weight of surface oxide, thickness of the anchor portion, magnitude of deflection due to the surface oxide, and magnitude of deflection due to the surface oxide and insulating coating were unanimously made satisfactory and these satisfactory performance parameter values in combination with adequate values of Cr content and $B_8$ value achieved excellently low iron loss in these steel sheet samples.

Further, it is understood by comparing steel sheet sample No. 3 with steel sheet sample No. 6, which samples are different from each other only in that thickness of the anchor portion of the former is outside our range, that iron loss properties significantly improve. i.e., iron loss is significantly reduced, by decreasing thickness of the anchor portion to 1.5 μm or less with appropriate coating weight of the surface oxide and magnitudes of deflection as required in our steel sheets.

Further, it is understood by comparing steel sheet sample No. 2 with steel sheet sample No. 4, which samples are different from each other only in that magnitude of deflection due to the surface oxide and insulating coating of the latter is outside our range, that iron loss properties significantly improve, i.e., iron loss is significantly reduced, by increasing magnitude of deflection due to the surface oxide and insulating, coating to 20 mm or more with appropriate coating weight and thickness of the anchor portion of the surface oxide and magnitudes of deflection by the surface oxide.

In contrast, steel sheet samples Nos. 1, 3, 4 and 8, each of which failed to meet at least one of the required performance parameter values of coating weight of surface oxide, thickness of the anchor portion, magnitude of deflection due to the surface oxide, and magnitude of deflection due to the surface oxide and insulating coating did not exhibit satisfactory iron loss properties.

Yet further, steel sheet samples Nos. 5, 9 and 10, where each of the samples satisfied all of manufacturing conditions requirements to achieve satisfactory values for all performance parameters, e.g., coating weight of the surface oxide but Cr content thereof exceeded 0.1 mass % and/or $B_8$ of the steel material thereof was less than 1.91 T, failed to exhibit satisfactory iron loss properties.

Experiment 2

Cold rolled steel sheet samples were prepared by: obtaining steel sample C having chemical composition including by mass %, C: 0.04%, Si: 3.2%, Mn: 0.05%, Ni: 0.01%, Cr: 0.12%, and Fe and incidental impurities as the balance and steel sample D having the same chemical composition as steel sample C, except that Cr content of steel sample D was changed to 0.02 mass %, by steelmaking, respectively; casting steel sample C and steel sample D, respectively, into steel slabs; subjecting the slabs to heating to 1400° C. and hot rolling to obtain hot-rolled steel sheets each having sheet thickness: 2.0 mm in a coiled state; subjecting the hot-rolled steel sheets to hot-band annealing at 1000° C., cold rolling to sheet thickness: 0.75 mm, intermediate annealing, and another cold rolling operation to the final sheet thickness of 0.23 mm.

Next, each of the cold roiled steel sheet samples was subjected to: decarburizing annealing in a wet hydrogen atmosphere at 850° C.; coating of an annealing separator prepared by adding 2 parts by mass of $SnO_2$ and 5 parts by mass of $TiO_2$ to MgO: 100 parts by mass; and final annealing at 1200° C.

At least one of manufacturing condition requirements (a) to (d) described below was controllably met during the manufacturing processes described above.

(a) Degree of Oxidation of Atmosphere During Decarburizing Annealing

Degree of oxidation of atmosphere during decarburizing annealing was variously adjusted such that $PH_2O/PH_2$ of the atmosphere was 0.30 to 0.60.

(b) Atmosphere in the Final Annealing

Hydrogen concentration in the heating process of 900° C. to 1100° C. was variously adjusted to 25% to 100%.

(c) Heating Pattern in Final Annealing

The average heating rate between 500° C. and 1200° C. was variously adjusted to 5° C./hour to 30° C./hour.

(d) Annealing Separator MgO

Lithium hydroxide was added to the annealing separator by 0 to 10 pans by mass with respect to MgO: 100 parts by mass.

Each of the finish-annealed steel sheet samples thus obtained was subjected to the same investigations as in Experiment 1.

Further, the steel sheet samples were coated with insulating coating mainly composed of colloidal silica and aluminum phosphate at controllably changed thickness and baked at 850° C. Magnetic domain refinement was then carried out for each of the steel sheet samples by using Q switch pulse laser in a direction orthogonal to the rolling direction under conditions including scanning rate in the sheet width direction: 15 m/second, irradiation pitch in the rolling direction: 6 mm, irradiation width: 150 μm, and irradiation interval: 7.5 mm.

The coating weight of the surface oxide after the final annealing, thickness of the anchor portion of the surface oxide after the final annealing, and the magnitude of deflection and magnetic properties of test pieces of each of the steel sheet samples are shown in Table 2.

TABLE 2

| No. | Steel sample ID | Condition requirement(s) selected in the final annealing | Coating weight in terms of basis weight of oxygan ($g/m^2$) | Thickness of anchor portion (μm) | Deflection caused by surface oxide (mm) | Deflection caused by surface oxide + insulating coating (mm) | Magnetic flux density $B_8$ (T) | Iron loss $W_{17/50}$ (W/kg) | Added amount of Cr (mass %) | Note |
|---|---|---|---|---|---|---|---|---|---|---|
| 11 | D | (a) + (b) + (c) + (d) | 4.5 | 0.5 | 13.0 | 35 | 1.935 | 0.68 | 0.02 | Example |
| 12 | D | (a) + (b) | 4.2 | 1.0 | 12.5 | 33 | 1.908 | 0.82 | 0.02 | Comp. Example |
| 13 | D | (b) + (c) + (d) | 4.0 | 1.6 | 12.0 | 30 | 1.933 | 0.76 | 0.02 | Comp. Example |
| 14 | D | (b) + (c) + (d) | 2.9 | 0.2 | 9.5 | 18 | 1.938 | 0.78 | 0.02 | Comp. Example |
| 15 | D | (c) + (d) | 3.9 | 0.7 | 13.0 | 35 | 1.940 | 0.68 | 0.02 | Example |
| 16 | D | (d) | 3.2 | 0.3 | 10.5 | 19 | 1.939 | 0.77 | 0.02 | Comp. Example |
| 17 | D | (a) + (c) + (d) | 4.0 | 0.5 | 13.0 | 35 | 1.935 | 0.69 | 0.02 | Example |
| 18 | C | (a) + (c) + (d) | 3.5 | 0.9 | 12.0 | 18 | 1.930 | 0.81 | 0.12 | Comp. Example |
| 19 | C | (a) + (c) | 4.6 | 1.2 | 15.0 | 40 | 1.924 | 0.80 | 0.12 | Comp. Example |
| 20 | C | (b) + (d) | 4.2 | 1.1 | 14.5 | 38 | 1.903 | 0.82 | 0.12 | Comp. Example |

※ Explanation of symbols of condition requirements selected in final annealing
(a) Degree of oxidation of atmosphere during decarburizing annealing
(b) Atmosphere in final annealing
(c) Heating pattern in final annealing
(d) Annealing separator MgO Steel sheet samples Nos. 11, 15 and 17 within our range each exhibited good iron loss properties as shown in Table 2. Specifically, at least one of manufacturing condition requirements (a) to (d) was adequately met in steel sheet samples Nos. 11, 15 and 17, whereby the coating weight of surface oxide, thickness of the anchor portion, magnitude of deflection due to the surface oxide, and magnitude of deflection due to the surface oxide and insulating coating were unanimously made satisfactory and these satisfactory performance parameter values in combination with adequate values of Cr content and $B_8$ value achieved excellently low iron loss in these steel sheet samples.

In contrast, steel sheet samples Nos. 13, 14, 16 and 18, each of which failed to meet at least one of the required performance parameter values of coating weight of surface oxide, thickness of the anchor portion, magnitude of deflection due to the surface oxide, and magnitude of deflection due to the surface oxide and insulating coating did not exhibit satisfactory iron loss properties.

Further, steel sheet samples Nos. 12, 19 and 20, where each of the samples satisfied manufacturing conditions requirements to achieve satisfactory values for all performance parameters, coating weight of the surface oxide but Cr content thereof exceeded 0.1 mass % and/or $B_8$ of the steel material thereof was less than 1.91 T, failed to exhibit satisfactory iron loss properties.

INDUSTRIAL APPLICABILITY

It is possible to obtain a grain oriented electrical steel sheet in which an iron-loss reducing effect through magnetic domain refinement by laser can be more effectively expressed than the prior art.

The invention claimed is:

1. A grain oriented electrical steel sheet having a forsterite coating, tension coating and magnetic flux density $B_8$ of 1.91T or more and subjected to magnetic domain refinement by laser irradiation, wherein:

(1) a content of Cr mixed into the grain oriented electrical steel sheet is 0.01 mass % or more and 0.1 mass % or less;

(2) a coating weight of the forsterite coating, in terms of basis weight of oxygen therein, is at least 3.0 $g/m^2$, an anchor portion is formed as a lower portion of the forsterite coating, biting a base metal of the grain oriented electrical steel sheet, and thickness of the anchor portion is 0.2 μm or more and 1.5 μm or less; and (3) a magnitude of deflection due to the forsterite coating of the grain oriented electrical steel sheet is at least 10 mm and a magnitude of deflection due to the forsterite coating and the tension coating of the grain oriented electrical steel sheet is at least 20 mm, when the grain oriented electrical steel sheet has length: 280 mm.

2. A method of manufacturing the grain oriented electrical steel sheet according to claim 1, comprising a series of processes including: rolling a slab with Cr content mixed therein 0.01 mass % or more and 0.1 mass % or less to obtain the steel sheet having a final sheet thickness; subjecting the steel sheet to decarburizing annealing; coating a surface of the steel sheet with an annealing separator mainly composed of MgO; subjecting the steel sheet thus coated to final annealing; providing the steel sheet with a tension coating; subjecting the steel sheet to magnetic domain refinement by laser irradiation in this order;

adjusting at least one of degree of oxidation of atmosphere during the decarburizing annealing, atmosphere in the final annealing, heating pattern in the final annealing, and an additive to the annealing separator MgO such that a coating weight of the forsterite coating formed on the surface of the steel sheet, in terms of basis weight of oxygen therein, is at least 3.0 g/$m^2$, thickness of the anchor portion as a lower portion of the forsterite coating, biting a base metal of the grain oriented electrical steel sheet, is 0.2 μm or more and 1.5 μm or less, and a magnitude of deflection of a test specimen having length: 280 mm and the forsterite coating on only one surface thereof, of the grain oriented electrical steel sheet, is at least 10 mm; and providing the steel sheet with the tension coating by coating and baking such that the magnitude of deflection of a test specimen having length: 280 mm and the forsterite coating and the tension coating on only one surface thereof, of the grain oriented electrical steel sheet, is at least 20 mm.

3. The method of claim 2, further comprising subjecting the slab for a grain oriented electrical steel sheet to the hot rolling, optionally hot-band annealing, and either one cold rolling operation or at least two cold rolling operations with intermediate annealing therebetween to obtain a steel sheet having the final sheet thickness.

* * * * *